United States Patent [19]

Smith, Jr. et al.

[11] 4,309,282

[45] Jan. 5, 1982

[54] PROCESS OF PHOSPHATE ORE BENEFICIATION IN THE PRESENCE OF RESIDUAL ORGANIC POLYMERIC FLOCCULANTS

[75] Inventors: Eugene L. Smith, Jr., Milford, Conn.; Andrew C. Poulos, Lakeland, Fla.; Richard E. Ellwanger, Tucson, Ariz.

[73] Assignee: American Cyanamid Company, Stamford, Conn.

[21] Appl. No.: 139,957

[22] Filed: Apr. 14, 1980

[51] Int. Cl.[3] ..... B03D 1/02

[52] U.S. Cl. ..... 209/166

[58] Field of Search ..... 209/8, 166, 167

[56] References Cited

U.S. PATENT DOCUMENTS

| | | | |
|---|---|---|---|
| 2,740,522 | 4/1956 | Ainone | 209/166 |
| 3,595,390 | 7/1971 | Booth | 209/166 |
| 3,827,557 | 8/1974 | Fischer | 252/61 X |
| 3,862,028 | 1/1975 | Jones | 209/166 |
| 4,081,363 | 3/1978 | Grayson | 209/166 |
| 4,090,972 | 5/1978 | Wang | 209/166 |
| 4,199,064 | 4/1980 | Holme | 209/166 |

FOREIGN PATENT DOCUMENTS

| | | | |
|---|---|---|---|
| 2157262 | 6/1972 | Fed. Rep. of Germany | 209/166 |
| 2338324 | 1/1977 | France | 209/166 |

*Primary Examiner*—Robert Halper

*Attorney, Agent, or Firm*—Paul W. Leuzzi

[57] ABSTRACT

Froth flotation of phosphate ore in the presence of residual organic polymeric flocculants is improved in recovery when a collector comprising a fatty acid derived from vegetable or mineral oils and a surface active agent is employed.

6 Claims, No Drawings

PROCESS OF PHOSPHATE ORE BENEFICIATION IN THE PRESENCE OF RESIDUAL ORGANIC POLYMERIC FLOCCULANTS

BACKGROUND OF THE INVENTION

This invention generally relates to an improved process of phosphate ore beneficiation by froth flotation. More particularly, this invention relates to such a process wherein phosphate ores are processed by froth flotation using as a collector a fatty acid in combination with a surface active agent.

Froth flotation is the principal means by which phosphate ores, such as pebble phosphate and apatite, and a host of other ores are concentrated. Its chief advantage lies in the fact that it is a relatively efficient process operating at substantially lower costs than many other processes capable of concentrating the ores.

Flotation is a process for separating finely ground valuable minerals from their associated gangue, or waste, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agent chosen must be capable of selectively coating the desired material in spite of the presence of many other mineral species. Current theory states that the flotation separation of one mineral species from another depends upon the relative wettability of surfaces. Typically, the surface free energy is purportedly lowered by the adsorbtion of heteropolar surface-active agents. The hydrophobic coating thus provided acts in this explanation as a bridge so that the particle may be attached to an air bubble. The practice of this invention is not, however, limited by this or other theories of flotation.

Typically, phosphate ore containing 15–35% BPL[bone phosphate of lime, $Ca_3(PO_4)_2$] is concentrated in very large tonnages from deposits such as the Florida pebble phosphate deposits. The ore slurry from strip mining is sized at about 1 millimeter and the coarser fraction, after scrubbing to break up mud balls, is a finished product. The minus 1 mm fraction is further sized at 35 and 200 mesh. The minus 200 mesh slime is discarded. From the sizing operation, the +35 mesh material in thick slurry is treated with fatty acid, fuel oil and caustic, ammonia or other alkaline material and the resulting agglomerates are separated on shaking tables, spirals, spray belts or flotation. The 35–200 mesh fraction is conditioned with the same type of reagents and floated by conventional froth flotation routes. Not all the silica gangue is rejected by the fatty acid flotation so the concentrate is blunged with acid to remove collector coatings, deslimed, washed free of reagents and subjected to an amine flotation with fuel oil at pH 7–8. This latter flotation, sometimes called "cleaning", removes additional silica and raises the final concentrate grade to 70–80% BPL.

The disposal of phosphate slimes generated in the beneficiation of phosphate ore, traditionally accomplished through the employment of slime ponds, has come under increased opposition from environmental grops as well as those interested in a more rapid reclamation of the water and land involved. To help resolve these objections, organic polymers have been frequently employed to flocculate and settle the slimes more rapidly. This particular solution, however, has brought with it related problems of a different nature. Specifically, the clear overflow water, which is recycled through the process, can contain residual organic polymeric flocculants which cause severe depression of the fatty acid collectors when employed in the beneficiation process. To overcome this effect, and thereby maintain acceptable recovery values, as much as double the normal amount of fatty acid collector may be required. It has been estimated that the total consumption of fatty acid products used by the Florida phosphate industry alone exceeds 100 million pounds per year. Doubling that amount not only would entail additional expenses but would divert large quantities of fatty acids from nutritional and other uses to which they might otherwise have been employed.

Thus, there exists the need for a process employing a phosphate ore collector whose selectivity is not depressed by residual amounts of organic polymeric flocculants contained in the recycled water. Additionally, in light of the requirements for fatty acids in nutritional and other areas and the high quantities of phosphate minerals being processed by froth flotation, a process wherein such a collector which does not require increased amounts of fatty acids would be particularly desirable. Accordingly, the provision for an improved process for beneficiating phosphate ore in the presence of residual polymers would fulfill a long felt need and constitute a significant advance in the art.

SUMMARY OF THE INVENTION

The present invention provides for a process of froth flotation for phosphate minerals where residual polymeric flocculants are present. The collector combination employed in this process enables higher recoveries to be achieved for phosphate minerals while concurrently minimizing the requirements of fatty acid consumption. It additionally permits the use of organic polymer flocculants, necessary for environmental considerations to be present without thereby producing depressed collector selectivity.

DESCRIPTION OF THE INVENTION

In accordance with the present invention there is provided a process for the froth flotation of phosphate values from an aqueous ore pulp containing residual organic polymer flocculants which comprises: conditioning said ore pulp with from about 0.1 to 5.0 pounds of collector per ton of ore, said collector comprising, in combination, from about 99.0 to 1.0 weight percent of a fatty acid derived from vegetable or animal oils and, correspondingly, from about 1.0 to 99.0 weight percent of a surface active agent and thereafter froth floating the phosphate values.

In carrying out the process of the present invention a combination of a fatty acid and surface active agents are used in admixture in froth flotation to enable a reduction in the requirements for scarce fatty acids to be achieved while maintaining high recovery and grade or improvements therein when residual amounts of organic polymeric flocculants are present.

The fatty acid used in the combination is one derived from a vegetable or animal oil. Suitable vegetable oils include those derived from babassu, castor, Chinese tallow, coconut, cottonseed, grapeseed, hempseed, kapok, linseed, wild mustard, oiticia, olive, ouri-ouri, palm, palmkernel, peanut, perilla, poppyseed, Argentine rapeseed, rubberseed, safflower, seasame, soybeam, sugarcane, sunflower, tall, teaseed, tung and ucububa oils. Suitable animal oils include those derived from fish and livestock. These oils contain acids ranging from about six carbons to about twenty-eight carbons in the alkyl moiety which may be saturated or unsaturated, hydroxylated or not, linear or cyclic, and the like.

Suitable surface active agents include, but are not limited to, glyceryl monooleate, sorbitan trioleate, sorbitan tristearate, propylene glycol monoesters, mono and diglycerides, ethoxylated propylene glycol, octyl phenol ethoxylate, sorbitan monooleate, polyoxyethylene oleyl ether, diethylene glycol monostearate, linear alcohol ethoxylate, sorbitan monopalmitate, polyethylene glycol ether of primary alcohol, sorbitan monolaurate, nonyl-phenol polyethylene glycol ether, alkylaryl polyether ethanol, ethoxylated alkylphenals, polyethylene glycol ether of secondary alcohol, tridecyl alcohol, polyoxyethylene sorbitan trioleate, alkylaryl sulfonate, $C_{12}$-$C_{15}$ linear primary alcohol ethoxylate, alkyl polyoxyalkylene ether, polyethylene glycol ether of primary alcohol, ethoxylated lanolin alcohols, ethoxylated stearyl alcohols, alkoxylated lanolin oil, ethoxylated castor oil, alkyl sulfonates, alkyl aryl sulfates, mono- and dialkyl sulfosuccinates, mono- and di-(alkoxylated primary or secondary alcohols or alkyl phenols) sulfosuccinates, alkyl amiclo(mono- or polyethoxyl) sulfosuccinates, N-alkyl sulfosuccinamates, mono- and di-alkyl(mono- and di-sulfonated)diphenyl oxides, alkyl and alkylaryl ether sulfates, alkyl and alkylaryl phosphates, perfluoralkyl alcohols, perfluoroalkyl carboxylates, perfluoroalkyl sulfonates, sulfonated fatty acids, alkyl ether propionic acids, alkyl polyalkoxy propionic acids; N,N-dialkyl taurates, N,N-alkyl alkylaryl taurates; N,N-alkyl aryl taurates, N-alkyl taurates, and the sulfonated Ritter reaction products of acrylonitril and olefins.

Preferably, the surface active agents are either partial polycarboxylic acid esters or sulfosuccinamates, the preferred partial polycarboxylic acid esters are derived from a polycarboxylic acid in which at least one free carboxylic acid group is present and which partial ester has the general structure:

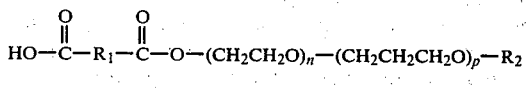

(I)

wherein $R_2$ is a linear or branched, saturated or unsaturated, radical having from 8 to 23 carbon atoms, inclusive, n is an integer of from 0 to 8 inclusive, p is an integer of from 0 to 8 inclusive, wherein n+p is equal to or greater than one (1), and $R_1$ is a bivalent grouping selected from $-(CH_2)_m-$ wherein m is an integer of 1 to 6, —CH=CH—,

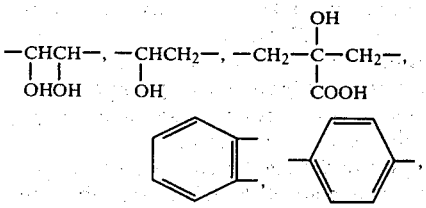

-continued

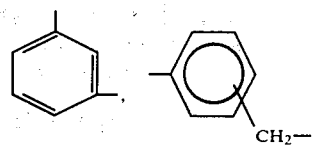

—$C_6H_8$—, and $C_6H_{10}$—.

Typically, the useful partial polycarboxylic acid esters are reaction products of an alcohol or alcohol ethoxylate of the general structure $R_2$—$(OCH_2CH_2CH_2)_p$—$(OCH_2CH_2)_n$—OH wherein $R_2$, n and p are as defined above and di- or tribasic acids such as maleic, citric, tartaric, succinic, adipic, phthalic, cyclohexyl dicarboxylic, cyclohexenyl dicarboxylic, terephthalic, and the like. The alcohol or alcohol ethoxylates may be derived from a single component or admixture of two or more alcohols. Most preferably the polycarboxylic acid used in forming the partial ester is maleic acid. Preferably an alcohol ethoxylate is used such that the alkyl group contains 11 to 15 carbon atoms.

The fatty acid and partial polycarboxylic acid ester are used in the combination such that the fatty acid will constitute from about 99.0 to 1.0 weight percent, preferably from about 95.0 to 80.0 weight percent, and, correspondingly, the partial polycarboxylic acid ester will constitute about 1.0 to 99.0 weight percent of the combination, preferably from about 5.0 to 20.0 weight percent. The specific combination providing maximum recovery will vary depending upon the specific phosphate ore processed, the specific combination components utilized and the like.

The preferred sulfosuccinamate is represented by the general structure

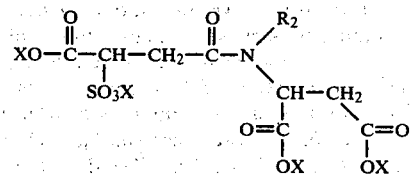

II.

wherein $R_2$ has the same significance as set forth above and X is selected from the group consisting of hydrogen, sodium, potassium and ammonium. The most preferred sulfosuccinamate being one in which $R_2$ has 18 carbon atoms.

In carrying out the process of the present invention, a phosphate ore is selected for treatment. The selected ore is screened to provide particles of flotation size according to the conventional procedures. Generally, the flotation size will encompass from about 30 to 150 mesh size.

After the selected mineral has been sized as indicated, it is slurried in aqueous medium and conditioned with the combination of fatty acid and surface active agents as well as such other additives as may be conventionally employed with the selected mineral. Such additives may include alkali or other pH adjusters, frother, fuel oil, foam control agents and the like as are well known to the skilled artisan.

The aqueous medium in which the phosphate ore is slurried will contain residual organic polymeric flocculants suc such as the polymers or co-polymers of acrylamide, acrylonitrile, acrylic acid, vinyl acetate, vinyl alcohol and the like, from approximately 0.1 to 20 parts per million, preferably 0.1 to 5.0 ppm. Depending upon the particular ore to be processed, the content of mineral solids in the slurry will vary according to conventional processing. Generally, the combination of fatty acid and surface active agents is used in an amount to provide a level of about 0.1 to 5.0 lbs. of the combination per ton of ore, preferably 0.5 to 2.0 lbs of the combination per ton of ore, although variations in amounts will occur with the specific mineral being processed and the amount of polymeric flocculants present within conventional ranges.

The conditioned slurry is then subjected to froth flotation in accordance with conventional procedures, the phosphate values being collected in the froth that forms as a result of the combination collector utilized in the instant invention.

The following specific examples illustrate certain aspects of the present invention, and more particularly, point out methods of evaluating the unique advantages of beneficiating phosphate ore with a collector combination comprising fatty acids and surface active agents when there is present in the recycled water residual amounts of organic polymeric flocculants. However, the examples are set forth for illustration only and are not to be construed as limitations of the present invention except as set forth in the appended claims. All parts and percentages are by weight unless otherwise specified.

GENERAL PROCEDURE

Step 1: Secure washed and sized feed, e.g., −35 to +150 mesh screen fractions. Typical feed is usually a mixture of 23% coarse with 77% fine fictation particles.

Step 2: Sufficient wet sample, usually 640 parts, to give a dry weight equivalent of 500 parts is washed once with about an equal amount of water. The water is carefully decanted to void loss of solids.

Step 3: The moist sample is conditioned for two minutes with approximately 100 cc of water, sufficient caustic as 5–10% aqueous solution to obtain a pH of 8.5 to 9.5 a mixture of 50% fatty acid as the collector and No. 5 fuel oil as a froth suppressor. Additional water may be necessary to give the mixture the consistency of "oatmeal" (about 69% solids). The amount of caustic will vary from 4 to about 20 drops. This is adjusted with a pH meter for the desired endpoint. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to the lip of the container). The percent solids in the cell is then about 14%. The pulp is floated for 2 minutes with air introduced after 15 seconds of mixing.

Step 5: The excess water is carefully decanted from the rougher products. The tails are set aside for drying and analysis.

Step 6: The products are oven dried, weighed and analyzed for percent bone phosphate of lime (hereinafter referred to as BPL). Recovery of the mineral values is calculated using the formula:

$$\frac{(W_c) \times (P_c)}{(W_c) \times (P_c) + (W_t) \times (P_t)} \times 100$$

wherein $W_c$ and $W_t$ are the oven-dry weights of the concentrate and tailings, respectively, and $P_c$ and $P_t$ are the weight percent of BPL of the concentrate and tailings, respectively.

COMPARATIVE EXAMPLE A

Using as the collector a tall oil fatty acid composition, a sample of Florida phosphate rock is processed according to the General Procedure described above in every material detail except that varying amounts of a commercial organic polymeric flocculant are present in the aqueous medium. Test conditions and results are given in Table I.

TABLE I

Effect of Organic Polymeric Flocculant on Fatty Acid Flotation of Phosphate Ore (Fuel Oil; Fatty Acid = 1:1; pH = 9.0; Head Assay = 22.5% BPL)

| Run | Dosage (lbs./ton) | Flocculant ppm | Percent Wt. Recovery | Assays (% BPL) Tail | Assays (% BPL) Conc. | Percent BPL Recovery |
|---|---|---|---|---|---|---|
| 1 | 0.5 | 0.0 | 21.0 | 10.14 | 68.99 | 64.4 |
| 2 | 0.5 | 0.1 | 20.5 | 11.15 | 66.48 | 55.0 |
| 3 | 0.5 | 0.5 | 13.6 | 15.90 | 64.46 | 39.0 |
| 4 | 0.5 | 1.0 | 6.4 | 19.94 | 59.87 | 17.0 |
| 5 | 0.5 | 2.0 | 4.4 | 20.09 | 54.76 | 10.7 |
| 6 | 0.5 | 4.0 | 5.4 | 20.77 | 52.88 | 10.7 |
| 7 | 0.5 | 8.0 | 5.0 | 21.32 | 45.00 | 10.0 |
| 8 | 0.5 | 12.0 | 5.2 | 21.24 | 45.43 | 10.5 |
| 9 | 0.75 | 1.0 | 20.0 | 11.53 | 66.38 | 59.0 |
| 10 | 1.0 | 1.0 | 22.2 | 9.77 | 67.12 | 66.2 |

EXAMPLE 1

The General Procedure described above is followed in every material detail using as the collector a mixture of a tall oil fatty acid and a partial polycarboxylic acid ester, the ratio of one to the other being 95.0 weight percent tall oil fatty acid and 5.0 weight percent partial polycarboxylic acid ester. The partial polycarboxylic acid ester is of the general formula:

$$HO-\overset{O}{\overset{\|}{C}}-CH=CH-\overset{O}{\overset{\|}{C}}-O-(CH_2CH_2O)_3-C_{12-13}H_{25-27}$$

The aqueous medium contains, in the present example, a commercial organic polymeric flocculant in an amount equal to 1.0 part per million. Test conditions and results are given in Table II.

TABLE II

EFFECT OF PARTIAL POLYCARBOXYLIC ACID ESTER ON FATTY ACID FLOTATION OF PHOSPHATE ORE IN PRESENCE OF ORGANIC POLYMERIC FLOCCULANT
(Fuel Oil: Collector Combination = 1:1; pH = 9.0; Head Assay = 22.5% BPL)

| Run | Dosage (lbs./ton) | Flocculant ppm | Percent Wt. Recovery | Assays (% BPL) Tail | Assays (% BPL) Conc. | Percent BPL Recovery | % Increase BPL Recovery |
|---|---|---|---|---|---|---|---|
| 4 | 0.5 | 1.0 | 6.4 | 19.94 | 59.87 | 17.0 | — |
| 11 | 0.5 | 1.0 | 16.6 | 13.87 | 69.66 | 51.4 | 202 |
| 9 | 0.75 | 1.0 | 20.0 | 11.53 | 66.38 | 59.0 | — |
| 12 | 0.75 | 1.0 | 20.4 | 10.84 | 68.00 | 61.7 | 4.6 |
| 10 | 1.0 | 1.0 | 22.2 | 9.77 | 67.12 | 66.2 | — |
| 13 | 1.0 | 1.0 | 23.0 | 8.50 | 69.36 | 70.9 | 7.1 |

TABLE III

PHOSPHATE ORE FLOTATION
(Fuel Oil: Collector Combination = 1:1; pH = 9.0)

| Example | Dosage (lbs./ton) | Flocculant ppm | Percent Wt. Recovery | Assays (% BPL) Feed | Assays (% BPL) Tail | Assays (% BPL) Conc. | Percent BPL Recovery | % Increase BPL Recovery |
|---|---|---|---|---|---|---|---|---|
| Comp. B | 0.6 | 1.0 | 12.4 | 22.06 | 15.26 | 70.09 | 39.4 | — |
| 2 | 0.6 | 1.0 | 23.0 | 20.57 | 5.88 | 69.75 | 78.0 | 98.0% |
| Comp. B | 1.0 | 1.0 | 28.5 | 22.57 | 4.30 | 68.40 | 86.4 | — |
| 2 | 1.0 | 1.0 | 32.3 | 22.18 | 1.81 | 64.89 | 94.5 | 9.4% |
| Comp. B | 1.4 | 1.0 | 31.6 | 26.42 | 7.01 | 68.51 | 81.8 | — |
| 2 | 1.4 | 1.0 | 32.8 | 23.22 | 3.05 | 64.55 | 91.2 | 11.5% |

COMPARATIVE EXAMPLE B

The General Procedure described above is followed in every material detail except that the phosphate ore is washed, prior to conditioning, with recycled water from the overflow of a 3-foot enviroclear thickener employing a commercial organic polymeric flocculant, the flocculant dosage in the recycled water being on the order of 1.0 parts per million. The phosphate ore is then froth floated employing a tall oil fatty acid as the collector. Again, the water used in the froth flotation contains residual amounts of a commercial organic polymeric flocculant in an amount on the order of 1.0 part per million. Test conditions and results are given in Table III.

EXAMPLE 2

The procedure of Comparative Example B is followed in every material detail except that the collector therein employed comprises a com ination of a tall oil fatty acid and a partial polycarboxylic acid ester of the general formula:

$$HO-\overset{O}{\overset{\|}{C}}-CH=CH-\overset{O}{\overset{\|}{C}}-O-(CH_2CH_2O)-C_{12-13}H_{25-27}$$

The relative ratio of fatty acid to the partial ester being 95.0 weight percent of the former and 5.0 weight percent of the latter. Test conditions and results are given in Table III.

EXAMPLE 3

The General Procedure described above is followed in every material detail using as a collector a mixture of a tall oil fatty acid and a partial ester of the general structure:

$$HO-\overset{O}{\overset{\|}{C}}-CH=CH-\overset{O}{\overset{\|}{C}}-O-(CH_2CH_2O)_3-C_{12-13}H_{25-27}$$

in the ratio set forth in Table IV. Test conditions and results are also given in Table IV.

TABLE IV

Effect of Partial Polycarboxylic Acid Ester on Fatty Acid Flotation of Phosphate Ore in Presence of Organic Polymeric Flocculant
(Fuel Oil : Collector Combination = 1:1; pH = 9.0; Head Assey = 22.5% BPL)

| Run | Collector | Dosage (lb/T) | Flocculant ppm | Percent Wt. Recovery | Assays(% BPL) Tail | Assays(% BPL) Conc. | Percent BPL Recovery | % Increase BPL Recovery |
|---|---|---|---|---|---|---|---|---|
| 4 | 100/0 tall oil FA/Partial Ester | 0.5 | 1 | 6.4 | 19.94 | 59.87 | 17.0 | — |
| 101 | 99/1 tall oil FA/Partial Ester | 0.5 | 1 | 13.7 | 14.34 | 73.88 | 45.0 | 165 |
| 11 | 95/5 tall oil FA/Partial Ester | 0.5 | 1 | 16.6 | 13.87 | 69.66 | 51.4 | 202 |
| 102 | 90/10 tall oil FA/Partial Ester | 0.5 | 1 | 19.4 | 10.34 | 73.01 | 63.0 | 271 |
| 103 | 75/25 tall oil FA/Partial Ester | 0.5 | 1 | 17.7 | 11.78 | 72.33 | 56.9 | 235 |
| 104 | 50/50 tall oil FA/Partial Ester | 0.5 | 1 | 20.3 | 10.74 | 68.66 | 62.0 | 265 |

EXAMPLE 4

The General Procedure described above is followed in every material detail using as a collector, a mixture of a tall oil fatty acid and a sulfosuccinamate of the general structure:

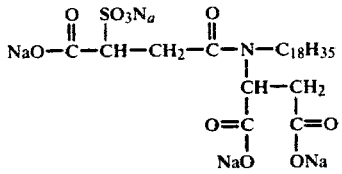

in the ratios set forth in Table V. Test conditions and results are also set forth in Table V.

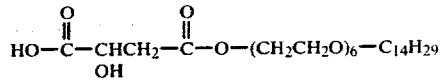

the ratio of the fatty acid to the partial polycarboxylic acid ester being about 70.0 to 30.0 weight percent, respectively, the total dosage employed being on the order of 3.0 lbs. per ton, substantially equivalent results are obtained.

TABLE V

Effect of Sulfosuccinamate on Fatty Acid Flotation of Phosphate Ore in Presence of Organic Polymeric Flocculant (Fuel Oil : Collector Combination = 1:1; pH = 9.0; Head Assay = 22.5% BPL)

| Run | Collector | Dosage (lb/T) | Flocculant (ppm) | Percent Wt. Recovery | Assays (% BPL) Tail | Assays (% BPL) Cone | Percent BPL Recovery | % Increase BPL Recovery |
|---|---|---|---|---|---|---|---|---|
| 4 | 100/0 tall oil FA/Sulfosuccinamate | 0.5 | 1 | 6.4 | 19.94 | 59.87 | 17.0 | — |
| 105 | 95/5 tall oil FA/Sulfosuccinamate | 0.5 | 1 | 19.2 | 10.66 | 72.45 | 61.7 | 263 |
| 106 | 90/10 tall oil FA/Sulfosuccinamate | 0.5 | 1 | 18.6 | 10.86 | 73.51 | 60.7 | 257 |
| 107 | 75/25 tall oil FA/Sulfosuccinamate | 0.5 | 1 | 17.4 | 11.88 | 73.01 | 56.4 | 232 |
| 108 | 50/50 tall oil FA/Sulfosuccinamate | 0.5 | 1 | 18.7 | 10.90 | 72.89 | 60.6 | 256 |

EXAMPLE 5

When the procedure of Example 2 is followed in every material detail except that the collector therein employed comprises a combination of a fatty acid derived from fish oil and a partial polycarboxylic acid ester of the general structure:

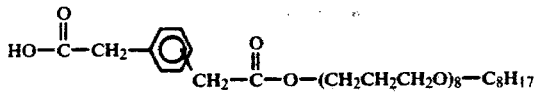

the ratio of the fatty acid to the partial polycarboxylic acid ester being about 80.0 to 20.0 weight percent, respectively, the total dosage employed being on the order of 0.1 lbs. per ton, substantially equivalent results are obtained.

EXAMPLE 6

When the procedure of Example 2 is followed in every material detail except that the collector therein employed comprises a combination of a fatty acid derived from castor oil and a partial polycarboxylic acid ester of the general structure:

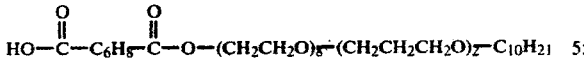

the ratio of the fatty acid to the partial polycarboxylic acid ester being about 99.0 to 1.0 weight percent, respectively, the total dosage employed being on the order of 2.0 pounds per ton, substantially equivalent results are obtained.

EXAMPLE 7

When the procedure of Example 2 is followed in every material detail except that the collector therein employed comprises a combination of a fatty acid derived from ouri-ouri oil and a partial polycarboxylic acid ester of the general structure:

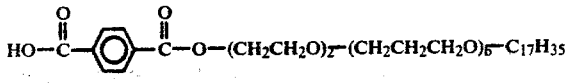

the ratio of the fatty acid to the partial polycarboxylic acid ester being about 50.0 to 50.0 weight percent, respectively, the total dosage employed being on the order of 4.0 pounds per ton, substantially equivalent results are obtained.

EXAMPLE 9

When the procedure of Example 2 is followed in every material detail except that the collector therein employed comprises a combination of a fatty acid derived from hempseed oil and a partial polycarboxylic acid ester of the general structure:

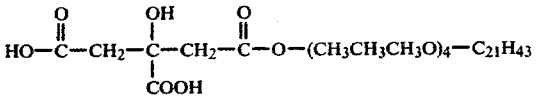

the ratio of the fatty acid to the partial polycarboxylic acid ester being about 20.0 to 80.0 weight percent respectively the total dosage employed being on the order of 5.0 pounds per ton. Substantially equivalent results are obtained.

What is claimed is:

1. A process for the froth flotation of phosphate values from an aqueous ore pulp containing about 0.1 to 5 parts per million of residual organic polymer flocculants which comprises: conditioning said ore pulp with from about 0.1 to 5.0 pounds of collector per ton of ore, said collector comprising, in combination, from about 99.0 to 1.0 weight percent of a fatty acid derived from vegetable or animal oils and, correspondingly, from about 1.0 to 99.0 weight percent of a surface active agent wherein the surface active agent is either a partial polycarboxylic acid ester of the general structure:

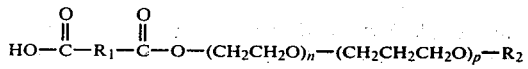

wherein $R_2$ is a linear or branched radical having from 8 to 23 carbon atoms, inclusive, n is an integer of from 0 to 8 inclusive, p is an integer of from 0 to 8 inclusive, wherein n+p is equal to or greater than (1) and $R_1$ is a bivalent grouping selected from $-(CH_2)_m-$ wherein m is an integer of 1 to 6, —CH=CH,

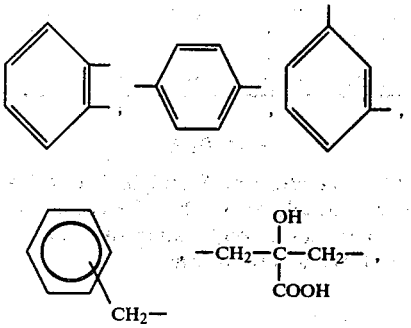

—$C_6H_8$—, and $C_6H_{10}$—, or is a sulfosuccinamate of the general structure:

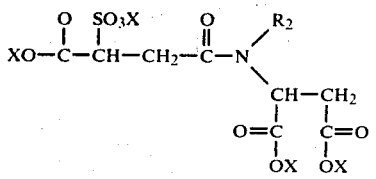

wherein $R_2$ is a linear or branched, saturated or unsaturated radical having from 8 to 23 carbon atoms, inclusive, and X is selected from the group consisting of hydrogen, sodium, potassium and ammonium and thereafter froth floating the phosphate values.

2. The process of claim 1 wherein from about 0.5 to about 2.0 pounds of collector per ton of ore is employed.

3. The process of claim 1 wherein the collector comprises from about 95.0 to 80.0 weight percent of a fatty acid and, correspondingly, from about 5.0 to 20.0 weight percent of a surface active agent.

4. The process of claim 1 wherein the fatty acid employed in the collector is derived from tall oil.

5. The process of claim 1 wherein the partial polycarboxylic acid ester employed in the collector is one in which $R_2$ is a linear or branched aliphatic radical having 11 to 15 carbon atoms, inclusive.

6. The process of claim 1 wherein the partial polycarboxylic acid ester employed in the collector is of the structure:

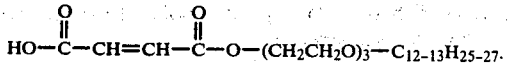

* * * * *